US006746012B2

(12) United States Patent
Diews

(10) Patent No.: US 6,746,012 B2
(45) Date of Patent: Jun. 8, 2004

(54) METHOD AND DEVICE FOR CONTROLLING ONE SHEET-MATERIAL GUIDING ELEMENT INDEPENDENTLY OF THE OTHER

(75) Inventor: Michael Diews, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 193 days.

(21) Appl. No.: 10/053,984

(22) Filed: Jan. 22, 2002

(65) Prior Publication Data

US 2002/0096820 A1 Jul. 25, 2002

(30) Foreign Application Priority Data

Jan. 19, 2001 (DE) ..... 101 02 223

(51) Int. Cl.[7] ..... B65H 1/04
(52) U.S. Cl. ..... 271/164; 271/171
(58) Field of Search ..... 271/164, 226, 271/221, 223, 224, 171, 227

(56) References Cited

U.S. PATENT DOCUMENTS

| | | | | |
|---|---|---|---|---|
| 1,948,001 A | | 2/1934 | Mensman et al. | |
| 3,841,622 A | * | 10/1974 | Swanson | 271/13 |
| 3,907,127 A | * | 9/1975 | Bollinger et al. | 414/788.9 |
| 3,987,911 A | * | 10/1976 | Euverard et al. | 414/795.7 |
| 4,068,839 A | * | 1/1978 | Bullock et al. | 271/180 |
| 4,231,565 A | * | 11/1980 | Ichikawa et al. | 271/105 |
| 4,245,830 A | * | 1/1981 | Fichte et al. | 271/164 |
| 4,329,589 A | * | 5/1982 | Stievenart et al. | 378/181 |
| 4,349,187 A | * | 9/1982 | Weyrich | 271/159 |
| 4,477,218 A | * | 10/1984 | Bean | 414/789.1 |
| 4,697,804 A | * | 10/1987 | Pollich | 271/162 |
| 4,700,941 A | * | 10/1987 | Shill | 271/151 |
| 4,776,578 A | * | 10/1988 | Hirakawa et al. | 271/223 |
| 4,811,939 A | * | 3/1989 | Keith | 271/146 |
| 4,971,311 A | * | 11/1990 | Tsukimoto | 271/227 |
| 5,076,562 A | * | 12/1991 | Sai et al. | 271/9.08 |
| 5,135,214 A | * | 8/1992 | Sugimoto et al. | 271/241 |
| 5,240,244 A | * | 8/1993 | Pollich et al. | 271/240 |
| 5,368,288 A | * | 11/1994 | Philipp et al. | 271/215 |
| 5,562,281 A | * | 10/1996 | Honda et al. | 271/308 |
| 5,944,477 A | * | 8/1999 | Shill | 414/788 |
| 6,073,925 A | * | 6/2000 | Sato | 271/171 |

FOREIGN PATENT DOCUMENTS

| | | |
|---|---|---|
| DE | 79 03 524 | 6/1980 |
| DE | 298 01 061 U1 | 4/1998 |
| DE | 198 16 181 A1 | 10/1998 |
| EP | 0 309 388 B1 | 3/1989 |
| EP | 0 894 755 A1 | 2/1999 |

* cited by examiner

*Primary Examiner*—Donald P. Walsh
*Assistant Examiner*—Daniel K Schlak
(74) *Attorney, Agent, or Firm*—Laurence A. Greenberg; Werner H. Stemer; Gregory L. Mayback

(57) ABSTRACT

A method for controlling elements for guiding sheet material and for controlling a surface for holding a sheet pile, which comprises registering, by a first sensor element, a lateral position of the sheet material and, based thereon, moving the surface for holding the sheet pile in a lateral direction, and controlling, via a sensor element for sensing a side edge of the sheet pile, independently of a first guide element, the lateral position of a further guide element, which is disposed on a side of the sheet pile, which is opposite to an aligning member for laterally aligning the sheet material and is assigned to an upper pile region; and a device for performing the method.

11 Claims, 2 Drawing Sheets

METHOD AND DEVICE FOR CONTROLLING ONE SHEET-MATERIAL GUIDING ELEMENT INDEPENDENTLY OF THE OTHER

BACKGROUND OF THE INVENTION

Field of the Invention

The invention relates to a method and a device for controlling elements which guide sheet material, such as are used, for example, in the feeder region of rotary printing machines for processing sheet material.

The published German Patent Document DE 298 01 061 U1 discloses the sensing of a sheet-pile edge for a sheet feeder. On a sheet feeder of a sheet processing machine, a sprung sensing roller is provided on a lateral edge of a sheet pile, and also a switch for registering the position of the sensing roller. The sensing roller is arranged on a lever that is pivotably connected to a holder which is guided format-adjustably in the sheet feeder. The lever is, in turn, braced or stressed by a leaf spring with respect to the holder, in a direction towards a zero position. The lever is pivotable to both sides from the zero position counter to the force of the leaf spring, it being possible for the pivoting movement of the lever in relation to adjustable tolerance limits to be registered by a switch. The leaf spring is firmly clamped into the holder and fixed laterally to the lever, however, it is fastened so as to be freely guided in the longitudinal direction.

The published European Patent Document EP 0 894 755 A1 discloses an aligning device for an automatic pile changer. Provided on a sheet-fed offset printing machine is a feeder having a non-stop device, also with a vertically adjustable residual pile carrier holding a residual pile, and also a pile support plate which is movable vertically and horizontally and holds a main sheet pile. Also provided are sensor devices, which are connected via an evaluation and control circuit to a drive for effecting a horizontal alignment of the pile support plate. What is sought to be achieved with such an aligning device is an exact alignment of the main pile with respect to the residual pile, in a structurally simple manner. For this purpose, the sensor devices are formed by a distance measuring system which is movable vertically via a lifting device, and by which, in a first position, the distance to the side surface of the residual pile and, in a second position located underneath, the distance to the side surface of the main pile can be registered and, by the evaluation and control circuit, the pile support plate can be moved via the drive in order that the two distance measured values are in agreement.

The published German Patent Document DE 198 16 181 A1 discloses a device for supplying sheets from a pile to a machine having a printing technology base. With this device, with little outlay of material and costs, lateral pile alignment of sheet material with increased accuracy and reliability is to be provided. A device for feeding sheet material includes a device for separating or singling the respective topmost sheet from the sheet pile, and also a device which conveys the separated sheet to the machine having a printing technology base. Also provided is a positioning device for the sheet pile, which permits controlled movement of the pile transversely with respect to the conveying direction, at least one feeler or detecting element being disposed in the region of a pile side edge that is provided, and also a feeler that reproduces the course of the pile side edge that is provided.

FIG. 1 diagrammatically shows a feeder for a sheet-processing machine according to the prior art, which has a sheet pile board holding a sheet pile, the pile board being movable in accordance with a sensor mechanism fitted to a first guide element.

At the feeder 1 of a machine for processing sheet material 5, such as a rotary printing machine, for example, the sheet material 5 is drawn off the upper side of a sheet pile and guided in a conveying direction represented by the arrow 2, in a conveying plane 3 corresponding to the plane of the drawing, to a front lay 9 aligning the leading edge of the sheet material 5. Lateral alignment of the sheet material 5, which may be formed, for example, of paper with light-weight or heavier-weight grammages and cardboard or pasteboard, is performed, in this regard, at a pulling device 10 provided at the operating side 8. The pulling device 10, which is arranged in a fixed location in relation to the conveying plane 3 of the sheet material 5, can be configured, for example, as a pulling lay, a pulling rail or a pulling roller, and imparts a lateral pulling travel Z, also identified by reference numeral 11, to the sheet material 5.

Stop surfaces 14 and 18, respectively, are provided on both sides, namely the drive side 7 and the operating side 8, of the sheet pile containing the sheet material 5. Each of the stop surfaces 14 and 18, respectively, includes a sensor element 13 and 17. In the case of the improvement in the feeder according to FIG. 1, which is disclosed in the prior art, the stop surface 18 provided on the operating side 8 is constructed in a fixed location. The pile gap F, also identified by reference numeral 12, or the distance or spacing between the side edge of the sheet material 5 and the stop surface 18, is fixedly prescribed and determines the position wherein the stop surface 18 is disposed. The position of the locally fixed stop surface 18 is determined from the difference between the pulling travel Z and the pile gap or distance F.

On the drive side 7, a dedicated drive, for example, in the shape of an electric motor, is assigned to the positionable stop surface 14. It is therefore possible for the controllable stop surface 14 to be controlled to a pile edge distance F, 12 in accordance with the course of the sheet pile edge.

A surface 15, whereon a pile of the sheet material 5 is held, likewise includes a dedicated drive with which the surface that holds the sheet pile can be moved to both sides in the direction of the travel movement represented by the double-headed arrow 16, 50 that the pile board can be kept between the locally fixed stop surface 18 and the positionable stop 14 while maintaining a distance F that is kept constant to the greatest possible extent on both sides.

In sheet-processing rotary printing machines, sheets located on a paper sheet pile are separated by suitable systems and fed to the printing unit. The feeding is carried out over a given laterally offset amount, i.e., the pulling travel, which, for the purpose of lateral alignment of the sheet material before it runs into the first printing unit at front lays on the feed table, is impressed onto the individual sheet based upon the individual position of the sheet. The pulling travel should remain as constant as possible. In the case of laterally wavy or stepped sheet piles, this leads to lateral tracking by the personnel operating the sheet-processing machine, i.e., the pressmen, or lateral tracking by automation in the form, for example, of automatic pile centering. In this regard, the distance of the upper pile region from the guide element on the pulling side, i.e., the operating side, is kept constant. The guide elements are used for lateral guidance of the sheets previously loosened by air. In order to keep the pulling travel as constant as possible, the guide elements should be as close as possible to the pile. If the sheet width fluctuates, due to the sheet cutting tolerance, it is possible for jamming or an excessively large guide spacing to occur on the non-pulling side. For given printing material grammages, this can in turn lead to stoppages or to lateral scatter of the sheets in relation to the pulling travel. Furthermore, in the case of manual adjustment of the guide element on the non-pulling side, for example, when the automatic system is deactivated, the guide element can be moved into the pile. In this regard, the pile and the guide element can be damaged.

SUMMARY OF THE INVENTION

In view of the foregoing corrective techniques heretofore known in the prior art, and also the indicated technical problem, it is an object of the invention to adapt the position of the guide elements guiding the sheet material to the position of the sheet pile, and to continuously monitor and possibly readjust the adaptation.

With the foregoing and other objects in view, there is provided, in accordance with the invention, a method for controlling elements for guiding sheet material and for controlling a surface for holding a sheet pile, which comprises registering, by a first sensor element, a lateral position of the sheet material and, based thereon, moving the surface for holding the sheet pile in a lateral direction, and controlling, via a sensor element for sensing a side edge of the sheet pile, independently of a first guide element, the lateral position of a further guide element, which is disposed on a side of the sheet pile, and opposite to an aligning member for laterally aligning the sheet material, the further guide element being assigned to an upper pile region.

In accordance with another mode, the method invention includes controlling the further guide element on the non-pulling side to a constant distance from the lateral pile edge of the sheet pile.

In accordance with a further mode, the method invention includes controlling the distance from the pile edge of the sheet pile facing away from the aligning member for laterally aligning the sheet material.

In accordance with an added mode, the method invention includes assigning a separate control device, independently of the first-mentioned guide element, to the further guide element.

In accordance with an additional mode, the method invention includes controlling with the separate control device a drive for moving the further guide element on a crossmember/spindle.

In accordance with yet another mode, the method invention includes, with the sensor element associated with the further guide element, sensing without contact a pile edge facing away from an aligning member for laterally aligning the sheet material.

In accordance with yet a further mode, the method invention includes, with the sensor element, continuously sensing the pile edge facing away from the aligning member.

In accordance with yet an added mode, the method invention includes cooperating the first guide element assigned to a pulling-side pile edge, and the first sensor element which, via a control, controls the drive of the surface holding the sheet pile.

In accordance with yet an additional mode, the method invention includes providing the control on the input side thereof with printing-material specific and alignment-specific parameters, and activating the control so as to set the position of the first guide element via a drive, which is controlled via the control provided with the parameters.

In accordance with still another mode, the method invention includes deactivating an automation system by registering a distance or spacing via the sensor element, and switching off the drive to the further guide element when a distance between the pile edge and the further guide element falls below a critical prescribable distance.

In accordance with still a further mode, the method invention includes measuring the distances between a first sensor and a first pile side edge, on the one hand, and a second sensor and a second pile side edge, on the other hand, and also the position of actuating motors, and, by a control computer, determining the sheet width.

In accordance with a concomitant aspect of the invention, there is provided a device for performing a method for controlling elements for guiding sheet material and for controlling a surface member for holding a sheet pile, comprising a first sensor element for registering a lateral position of the sheet material and, based thereon, for moving the surface for holding the sheet pile in a lateral direction, a first guide element and a further guide element, and a sensor element for sensing a side edge of the sheet pile, independently of the first guide element, for controlling the lateral position of the further guide element disposed on a side of the sheet pile, which is opposite to an aligning member for laterally aligning the sheet material, the further guide element being assigned to an upper pile region.

The advantages that can be achieved with the improvement according to the invention are primarily to be seen in the fact that the guide element of the non-pulling side is controlled at a constant distance from the lateral pile edge of the non-pulling side. By continuous distance measurement between guide element and pile edge, and also by subsequent automatic movement of the guide element on the non-pulling side, this guide element is prevented from being moved too close to the pile or into the pile. This constitutes an additional safety aspect, for example, when the automation system is deactivated, i.e., the lateral control of the sheet pile is switched off, and protects the pile of printing material, which represents a considerable cost factor, against damage and therefore against non-usability.

In a further refinement of the idea upon which the invention is based, the further guide element arranged on the non-pulling side is controlled to a constant distance from a lateral pile edge. This distance depends upon the sheet format that can be processed and is readjusted based upon the course of the pile edge on the non-pulling side. During the sensing required for the control of the guide element on the non-pulling side, the lateral pile edge of the sheet pile which is sensed is the edge of the sheet pile facing away from the aligning member for the lateral alignment of the sheet material. Thus, the position of the further guide element, i.e., of the guide element arranged on the non-pulling side, which in each case depends upon the course of the pile edge, may be guided to follow the critical pile edge of the sheet pile directly, in real time and without requiring any further conversion equipment.

In order to decouple the control of the further guide element from that of the first guide element provided in the upper pile region, an independent, separate control device is provided. The independent, separate control device is not incorporated into the automatic control of the first guide element nor the control of the lateral position of the platform that holds the sheet pile, so that, even when the automatic system for tracking the sheet pile is deactivated, a safeguard is provided against collision on the non-pulling side of the sheet pile, by sensing the pile edge on the non-pulling side of the sheet pile. Via the separate control, which controls the lateral position of the further guide element held on the upper side of the sheet pile, the position on a crossmember can be moved laterally via a drive, preferably an electric motor drive, which drives only the further guide element.

The sensor mechanism associated with the further guide element senses without contact the pile edge facing away from the aligning member, for example, a pulling lay or a pulling roller, on the surface of the feeding table for the sheet material, for the lateral alignment of the sheet material. The non-contact sensing is performed in order to determine the current respective distance or spacing of the sheet pile edge from the stop surface which is formed on the further guide element. Depending upon the course of the pile edge on the side of the sheet pile, which faces away from the aligning member for the lateral alignment of the sheet material, the drive of the further guide element on the crossmember is activated, it being possible for the activation to be performed by an electric motor, for example, which drives a threaded spindle which, in turn, moves the further guide element towards the pile edge or away from the latter transversely with respect to the conveying direction in the upper guide pile region. In order to ensure permanent monitoring of the sheet pile edge on the non-pulling side, for example, when the automatic tracking of the platform holding the sheet pile is deactivated, the control of the further guide element is continuously active, i.e., is accordingly not switched off when the sheet pile control is deactivated.

The first guide element, which is arranged on the side of the sheet pile whereon the aligning member for the lateral alignment of the sheet material is also accommodated, is controlled via a sensor mechanism which, via a controller, controls the drive of the surface that holds the sheet pile in the lateral direction. Therefore, on the pulling side of the sheet pile, the tracking thereof to a given desired lateral distance between the sheet pile edge on the pulling side and the first guide element can be carried out, independently of the control loop of the further guide element at the sheet pile edge on the non-pulling side.

When the control is activated, the position of the first guide element is set via a drive which is controlled via a control which, on the input side, is provided with printing-material specific and alignment-specific parameters. Such parameters may be, for example, the respective printing material format to be processed, also the distance at which the first guide element is to be controlled to the pile edge on the Pulling side of the sheet pile. When the automation system is deactivated, i.e., the control of the first guide element for readjusting the surface that holds the sheet pile, by continuously registering the distance between the sheet pile edge on the non-pulling and the further guide element via the sensor mechanism when it falls below a critical distance or spacing between the pile edge and the further guide element, is switched off, the drive of the further guide element is stopped. Therefore, in the case of manual actions by the printers, who previously have switched off the automatic control of the sheet pile position based upon a first guide element in the upper pile region, the opposite side of the sheet pile is preserved against damage during actions which are manually performed.

Other features which are considered as characteristic for the invention are set forth in the appended claims.

Although the invention is illustrated and described herein as embodied in a method and device for controlling sheet-material guiding elements, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
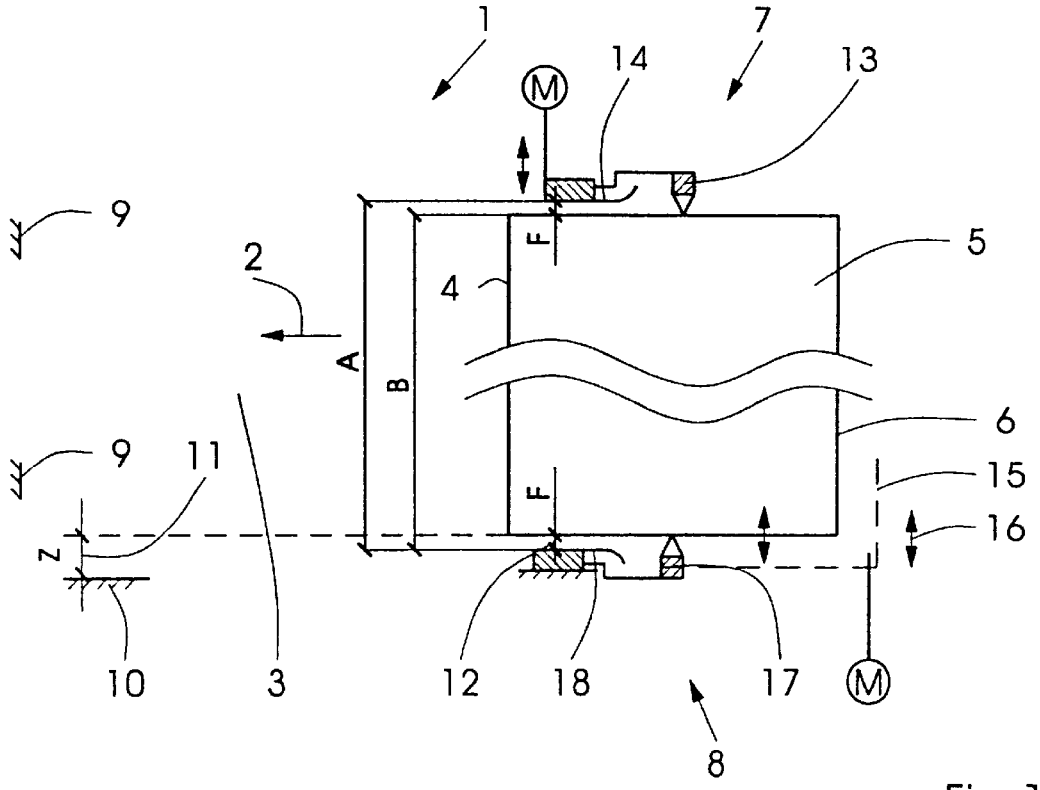
Fig.1 Prior Art
FIG. 1 is a diagrammatic plan view, partly in section, of a feeder for a sheet-processing machine, with a controlled pile board position and a controlled lateral stop surface.
Figure 2:
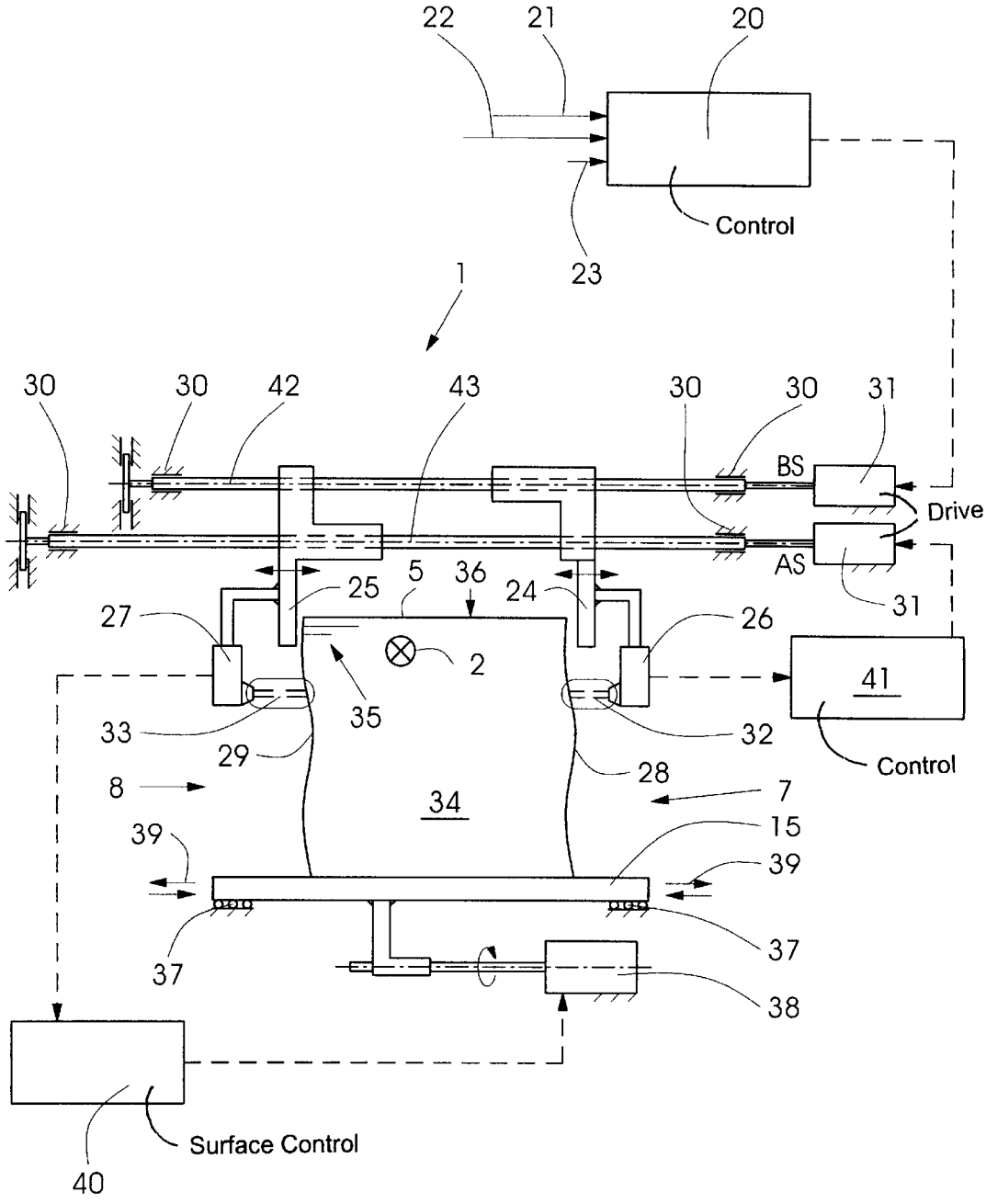
FIG. 2 is a diagrammatic side elevational view of the device according to the invention for distance control of guide elements which are positionable beside a previously loosened upper pile region.

FIG. 2 reveals in detail the improvement according to the invention of the instant application for distance control of guide elements positioned beside the previously loosened upper pile region.

In the improvement according to the invention of the instant application, which is reproduced in a side elevational view in FIG. 2, a sheet pile 34 is held on a surface 15. An upper region 35 of the sheet pile 34 of sheet material is previously loosened by the entry of blown air. The entry of blown air in the upper pile region 35 achieves secure and reliable separation or singling of the individual copies of the sheet material 5. The separated copies are conveyed in the conveying direction 2 in a conveying plane extending perpendicularly to the plane of the drawing, are aligned at front lays 9 (not shown in FIG. 2) and then, accelerated to machine speed, are conveyed into the printing units of a sheet-processing machine.

Above the upper pile region 35, two crossmembers or traverses 42 and 43, respectively, are disposed extending over the width of the sheet pile 34. The crossmembers 42 and 43 are constructed as guide/threaded spindles, and to each of the crossmembers 42 and 43, respectively, there are assigned a dedicated drive 31 on the operating side 7 of the sheet pile 34. The upper crossmember 42 serves for driving a first guide element 25 on the operating side 8 of the sheet pile 34. The first guide element 25 is guided transversely with respect to the pile direction 34 on the lower crossmember 43 and is provided with the drive thereof by the threaded section formed on the upper crossmember 42. Both crossmembers 42 and 43 are mounted in mounting supports 30 on the operating side 8 and the drive side 7, respectively, in the feeder region 1, and are secured against horizontal displacement by axial bearings.

A further guide element 24, assigned to the upper region 35 of the sheet pile 34, is guided on the upper crossmember 42 and, by a threaded section formed on the lower crossmember 43, is moved in the lateral direction relative to the sheet pile 34, in accordance with the double-headed arrow shown. A sensor element 26 and 27, respectively, is assigned to the first guide element 25 and the further guide element 24. The sensor elements 26 and 27, respectively, can advantageously be secured to the outer side of the guide elements 25 and 24, respectively, and can be constructed so that the sensor elements 26 and 27, respectively, extend in the direction towards pile edges 28 and 29, respectively, on the drive side 7 and the operating side 8, respectively, of the sheet pile 34. The sensor elements 26 and 27 are preferably of non-contact or contactless construction, and register the current lateral distances or spacings 32 and 33, respectively, between the sensor elements 26 and 27, respectively, and the side edges 28 and 29, respectively, of the sheet pile 34.

The sensor element 27, which is assigned to the first guide element 25, is connected to a control 40 for the surface of the board 15 that supports or holds the sheet pile 34. The surface board 15 that supports the sheet pile 34 is movable in the lateral direction represented by the arrow 39. To this end, the surface of the board 15 that holds the sheet pile 34 is mounted on mounting supports 37 which absorb the load of the sheet pile 34. In addition, the surface of the board 15 is movable laterally in the direction of the arrows 39 by a drive 38 assigned to the surface board 15. The extent of the lateral movement travel 39 depends upon the course of the pile edge 29 on the operating side 8 of the feeder 1. Depending upon the course of the pile edge 29 of the sheet pile 34, the surface of the board 15 that holds the sheet pile 34 is controlled in accordance with the current pile edge distance or spacing 33 between the pile edge 29 and the sensor element 27.

The sensor element 26, which is assigned to the further guide element 24 and which senses the pile edge 28 of the sheet pile 34, preferably without contact and continuously, is connected to a separate control device 41. The control device 41 connected to the sensor element 26 on the drive side 7 controls the drive 31, which acts upon the crossmember 43 serving as a drive spindle for the further guide element 24. Accordingly, the possibility, therefore, exists of controlling the further guide element 24 in relation to the lateral position thereof at the upper region 35 of the sheet pile 34, independently of the first guide element 25.

The drive 31, which acts upon the upper crossmember 42 formed partly as a threaded spindle, is activated via a control 20. On the input side, the control 20 has available thereto information 21 about the pulling travel, and also information 22 about the printing material format to be processed. In addition, the center offset 23 can be input to the control device 20. From this information, on the output side of the controller, an activation signal for the drive 31 of the upper crossmember 42, formed partly as a threaded spindle, is determined, which moves the first guide element 25 while maintaining a given prescribable distance or spacing from the pile side edge 29. This first adjustment can be made within the context of presetting, i.e., when setting up a new job. By the sensor mechanism 27 provided on the first guide element 25, during production or continuous printing, i.e., continuous separation or singling of copies of sheet material 5 in the upper region 25 of the sheet pile 34, the control unit 40 for the pile support board 15 tracks the lateral offset 39 of the latter in accordance with the course of the pile edge 29 facing the operating side 8.

Independently thereof, the drive 31 which acts upon the lower crossmember 43 is controlled via the sensor element 26 connected to the further guide element 24. Via the drive 41, the further guide element 24 can be guided so as to follow the course of the pile side edge 28 facing the drive side 7. The tracking of the further guide element 24 to the pile side edge 28, i.e., on the non-pulling side of the sheet pile 34, is performed by virtue of the independent control loop 41, 31, independently of the tracking of the first guide element 25 on the pile edge 29 on the operating side of the sheet pile 34. Due to the decoupling of the control loop 26, 41, 31 for the further guide element 24, the latter can be controlled independently of the control loop 27, 40, 38, so that, in the event of deactivation of the automatic pile tracking, i.e., of the controller 40, or manual adjustment of the first guide element 25, assurance is provided that the control loop 41 controlling the lateral position of the further guide element 24 remains activated at all times and prevents the occurrence of any collision between the upper region 35 of the sheet pile 34 and the further guide element 24. This is required in particular when the pile tracking control is deactivated by the pressman when adjustments have to be performed manually. The independent control of the lateral position of the further guide element 24 in relation to the upper region 35 of the sheet pile 34 also takes into account that the further guide element 24 on the drive side 7 of the feeder 1 is difficult to access. Using the separate control loop proposed according to the invention for the further guide element 24, manual intervention of the pressman in order to prevent a collision between the further guide element 24 and the previously loosened upper region 35 of the sheet pile 34 is no longer required.

The sensors 26 and 27, respectively, which sense the pile edges 28 and 29, respectively, on the drive side 7 and the operating side 8, respectively, preferably register the course of the pile edges 28 and 29 without contact. During the sensing of the pile edges 28 and 29 by the sensors 26 and 27, respectively, assurance is provided that this sensing is performed continuously. This applies in particular to sensing the drive-side, i.e., the non-pulling-side pile edge 28 of the sheet pile 34 of the sheet material 5. In the event of a deactivation of the automatic tracking, i.e., the activated automation system, the continuous distance measurement of the distance 32 between the sensor element 26 on the drive side 7 and the drive-side pile edge 28 prevents the further guide element 24 from coming too close to the upper region 35 of the sheet pile 34 or from moving into the pile. In the event that the distance between the drive-side pile side 7 and the sensor element 26 falls below a given prescribable distance or spacing 32 during a motor-driven or manual adjustment, the drive 31 which moves the further guide element 24 laterally is switched off, so that damage to the pile side edges on the drive side 7 of the sheet pile 34 due to an inadvertent movement of a further guide element 24, which guides the printing material 5 laterally, the inadvertent movement being into the region of the sheet pile 34, is avoided.

From the distance determined between the sensor 26 and the pile side edge 28, on the one hand, and the sensor 27 and the pile side edge 29, on the other hand, and also the position of the actuating motors 31, the approximate sheet width can be calculated by the control computer 41.

This value can be passed on by the control computer 41 to following sheet guidance or processing devices in order to set them with regard to the width of the material to be processed.

I claim:

1. A method for controlling elements for guiding sheet material and for controlling a surface for holding a sheet pile, which comprises:

registering, by a first sensor element connected to a first guide element, a lateral position of the sheet material and, based thereon, moving the surface for holding the sheet pile in a lateral direction, the first sensor element sensing a first pile edge of the sheet pile; and controlling, via a second sensor element for sensing a second pile edge of the sheet pile opposite the first pile edge, a lateral position of a second guide element independently of the first guide element, the second guide element being disposed on a side of the sheet pile opposite to the first guide element, the second guide element being assigned to an upper pile region.

2. The method according to claim 1, which includes assigning the second guide element to a non-pulling side and controlling the second guide element to a constant distance from the second pile edge of the sheet pile.

3. The method according to claim 1, which includes assigning a separate control device, independent of the first guide element, to the second guide element.

4. The method according to claim 3, which includes controlling with the separate control device a drive for moving the second guide element on a crossmember.

5. The method according to claim 1, which includes, with the second sensor element associated with the second guide element, sensing without contact the second pile edge facing away from the first guide element.

6. The method according to claim 5, which includes, with the second sensor element, continuously sensing the second pile edge.

7. The method according to claim 1, which includes cooperating the first guide element assigned to a pulling-side pile edge with the first sensor element, for controlling, via a control, a drive of the surface holding the sheet pile.

8. The method according to claim 1, which includes:

setting a position of the first guide element by a drive activated by a control; and providing an input side of the control with printing material-specific and alignment-specific parameters.

9. The method according to claim 1, which includes in the event of an a deactivated automation system, switching off a drive to the second guide element when a distance between the second pile edge and the second guide element falls below a critical prescribable distance.

10. The method according to claim 1, which includes measuring distances between the first sensor element and the first pile edge, and a the second sensor element and the second pile edge, and also a position of actuating motors, and, by a control computer, determining a sheet width.

11. A device for performing a method for controlling elements for guiding sheet material and for controlling a surface member for holding a sheet pile, comprising:

a first guide element disposed at a first side of the sheet pile;

a second guide element disposed at a second side of the sheet pile opposite the first side, said second guide element being assigned to an upper region of the sheet pile;

a first sensor element connected to said first guide element for sensing a lateral position of the sheet material and, based thereon, for moving the surface for holding the sheet pile in a lateral direction; and a second sensor element connected to said second guide element for sensing a side edge of the sheet pile and, based thereon, for controlling a lateral position of said second guide element independently of said first guide element.

* * * * *